United States Patent [19]

Kito et al.

[11] Patent Number: 4,694,894

[45] Date of Patent: Sep. 22, 1987

[54] HEAT EXCHANGERS

[75] Inventors: Masahiro Kito, Brighton; Katsuhiro Mori, Hove, both of England

[73] Assignee: Aisin Seiki Kabushiki Kaisha, Kariya, Japan

[21] Appl. No.: 776,669

[22] Filed: Sep. 16, 1985

[30] Foreign Application Priority Data

Sep. 14, 1984 [GB] United Kingdom ..... 8423320

[51] Int. Cl.[4] ..... F28F 13/00

[52] U.S. Cl. ..... 165/135; 165/160; 165/908; 181/283; 122/142; 122/149; 122/160

[58] Field of Search ..... 165/DIG. 908, 135, 160, 165/161; 122/142, 149, 160, 182 S; 126/431, 360 R, 364; 181/283

[56] References Cited

U.S. PATENT DOCUMENTS

| | | | |
|---|---|---|---|
| 1,734,310 | 11/1929 | Taylor | 122/149 |
| 1,804,777 | 5/1931 | Jerome | 122/149 X |
| 2,080,404 | 5/1937 | Hunter et al. | 122/149 |
| 2,532,527 | 12/1950 | Woolery | 122/149 X |
| 3,631,842 | 1/1972 | Hededam | 122/149 |
| 4,263,878 | 4/1981 | Hurley et al. | 122/149 X |
| 4,450,932 | 5/1984 | Khosropour et al. | 181/283 X |
| 4,471,754 | 9/1984 | Gultz | 165/155 X |
| 4,487,289 | 12/1984 | Kicinski et al. | 181/283 X |

FOREIGN PATENT DOCUMENTS

| | | | |
|---|---|---|---|
| 717396 | 1/1942 | Fed. Rep. of Germany | 165/161 |

*Primary Examiner*—Albert W. Davis, Jr.
*Assistant Examiner*—Peggy Neils
*Attorney, Agent, or Firm*—Oblon, Fisher, Spivak, McClelland, & Maier

[57] ABSTRACT

A heat exchanger which includes a casing having an outer tube and an inner tube fixed therein. Holes are formed in the inner tubes and face a heat transfer surface of the outer tube. Hot exhaust gas may be passed from an inlet of the outer tube into the inner tube, through the holes in the inner tube to an outlet. Coolant water may be passed through the casing from an inlet port to an outlet port. Baffles and/or twist coils may be provided to improve heat transfer.

8 Claims, 7 Drawing Figures

HEAT EXCHANGERS

BACKGROUND OF THE INVENTION

Field of the Invention

The invention relates to heat exchangers for transferring heat between fluids without mixing.

SUMMARY OF THE INVENTION

A heat exchanger according to the invention comprises a casing, an outer tube fixed in the casing, and an inner tube fixed in the outer tube and provided with a number of holes in a circumferential surface thereof, a heat transfer surface of the outer tube directly facing the holes.

By passing one fluid, which may be a gas, through the inner and outer tubes, efficient heat exchange may be obtained with another fluid, which may be a liquid, located in the casing. A compact heat exchanger can thus be manufactured, or a heat exchanger of greater efficiency than others of the same size can be obtained.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
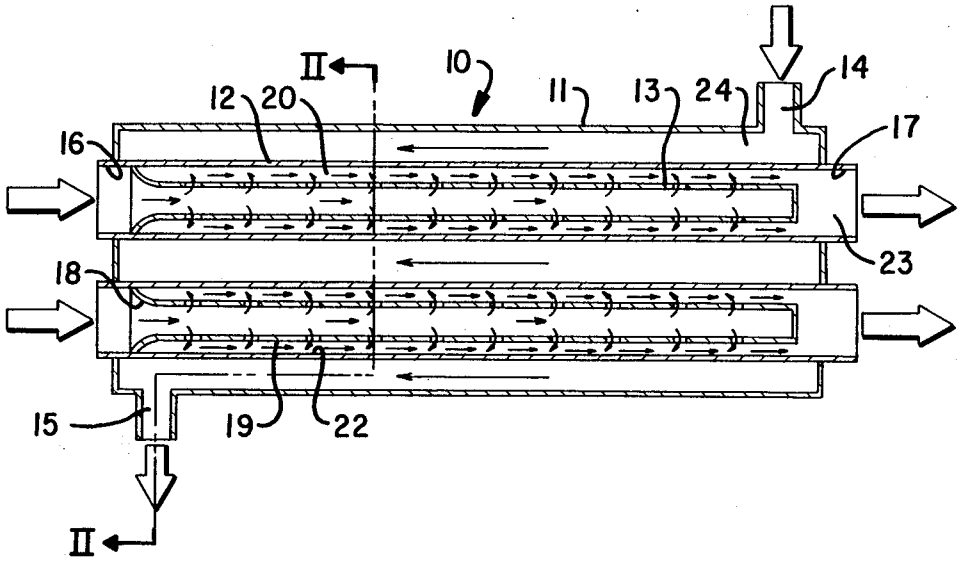
FIG. 1 is a longitudinal sectional view taken through a first embodiment of the heat exchanger according to the invention.
Figure 2:
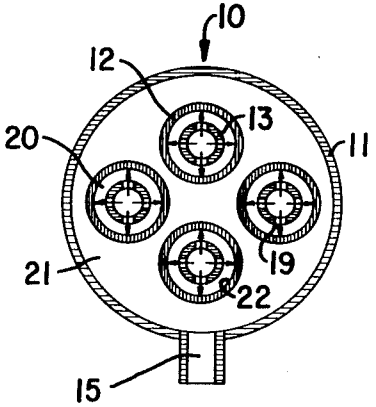
FIG. 2 is a transverse sectional view taken along II—II in FIG. 1.

Referring now to FIGS. 1 and 2, a heat exchanger 10 includes a casing 11 having a hollow cylindrical shape, a plurality of outer tubes 12 fixed in the casing 11, and a plurality of inner tubes 13 fixed in each outer tube 12. The casing 11 is provided with inlet and outlet ports 14, 15 for one fluid, for example coolant water. The outer tubes 12 have an inlet 16 at one end and an outlet 17 at the other. The inner tube 13 has an opening 18 at one end and holes 19 formed in a circumferential surface of tube 13 for another fluid, for example a high temperature exhaust gas. The exhaust gas passes from the inlet 16 to the outlet 17 via the opening 18, holes 19 and a space 20 formed between the tubes 13 and 12. The water passes from the inlet port 14 to the outlet port 15 via a space 21 between the casing 11 and the outer tube 12, and thus is warmed by the exhaust gas and can be used as hot water.

In this operation, the exhaust gas strikes an inner wall 22 of the outer tube 12 (i.e., heat transfer surface), passing through holes 19 in the inner tube 13 as a jet stream. The heat transfer coefficient at the inner wall 22 of the outer tube 12 is promoted by this jet stream effect, or the heat exchanger can be made compact. The exhaust gas is then guided into an expansion space 23 in the outer tube 12 which reduces the exhaust noise.

In this embodiment, the heat exchanger 10 has a number of outer tubes 12, but might alternatively have a single outer tube with a single inner tube 13 therein. The heat exchanger 10 is designed with consideration of the diameter and number of the holes 19 in the tube 13 depending on the required capacity and other factors.

Figure 3:
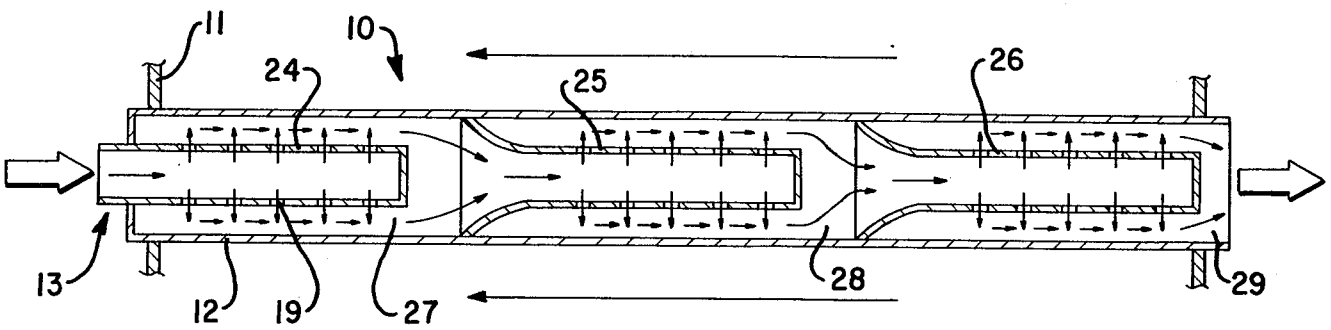
FIG. 3 is a longitudinal sectional view taken through a second embodiment of the heat exchanger according to the invention.

Referring now to the second embodiment as shown in FIG. 3, the inner tube 13 comprises three parts 23,25,26, each part having a number of holes 19. Three expansion spaces 27,28,29 are provided which are effective for reducing the noise of fluid. Alternatively, more or less than three parts may be provided for the inner tube 13. Thus the jet stream effect is repeatedly obtained, so that the heat transfer coefficient is higher than in FIG. 1. The pressure loss is also higher so this embodiment is suitable for a heat exchanger in which a high pressure loss is allowable. It is also suitable when the space is too confined to hold a large number of tubes as in FIG. 1, and when the flow rate of the fluid is low.

Figure 4:
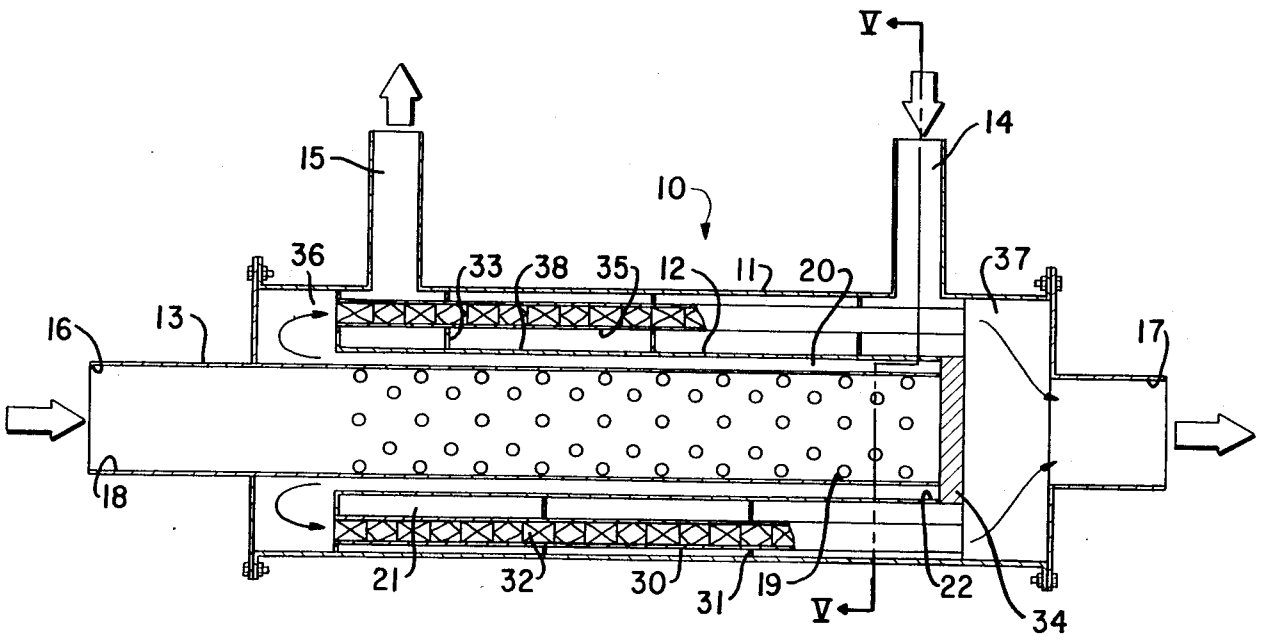
FIG. 4 is a longitudinal sectional view taken through a third embodiment of the heat exchanger according to the invention.
Figure 5:
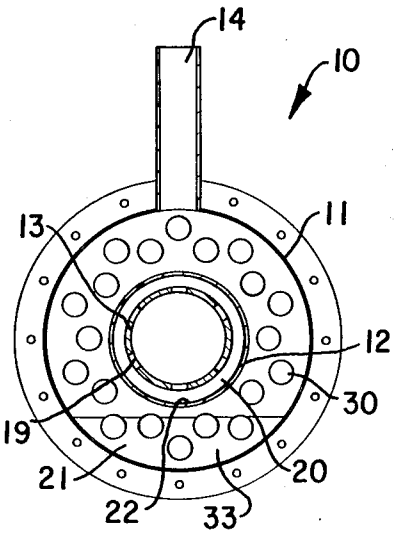
FIG. 5 is a transverse sectional view taken along line V—V in FIG. 4.

In the third embodiment as shown in FIGS. 4 and 5, the inner tube 13 is fixed to the casing 11. The outer tube 12 also is fixed to the casing 11 and is provided with a number of twist tubes 30 and a baffle 31. Each twist tube 30 has a series of twist strips 32 therein for providing a high heat transfer coefficient. The twist strips 32 promote turbulence in the fluid and break its boundary layer so that a high heat transfer coefficient is obtained. The baffle 31 comprises a number of plates 33 for regulating the flow of fluid. A seal 34 positioned in said outer tube prevents the fluid entering the opening 18 at the end of the inner tube 13, from leaking into the expansion space 37. A sound-absorbing material or a heat insulating material for the seal 34 can be utilized. Expansion chamber spaces 36,37 at each end also serve to reduce noise.

The gas passes from the inlet 16 of the inner tube 13 to the outlet 17 via holes 19 in the inlet tube 13, the space 20 between the inner tube 13 and the outer tube 12, the expansion chamber space 36, the twist tube 30, and expansion space 37. The water passes from the inlet port 14 of the casing 11 to the outlet port 15 via the space 21 between the casing 11 and an inside wall 38 of the outer tube 12. The gas strikes the inner wall 22 of the outer tube 12 (the first heat transfer surface) through the holes 19 as a jet stream, and is then guided to the inner circumferential surface 35 of the twist tube 30 (the second heat transfer surface). Thus high heat exchanger effectiveness is obtained. The two expansion spaces 36,37 are most effective. The inner tube 13, being centrally located, supplies the jet stream effect. The twist tubes 30 surrounding the inner tube 13, and the casing 11 enclosing the entirety, makes for efficient use of space. The flow of the fluid from the space 20 is disturbed in the expansion space 36, so the flow rate in each twist tube 30 is almost the same. Thus there is no need for a diffuser in front of the tubes 30.

Figure 6:
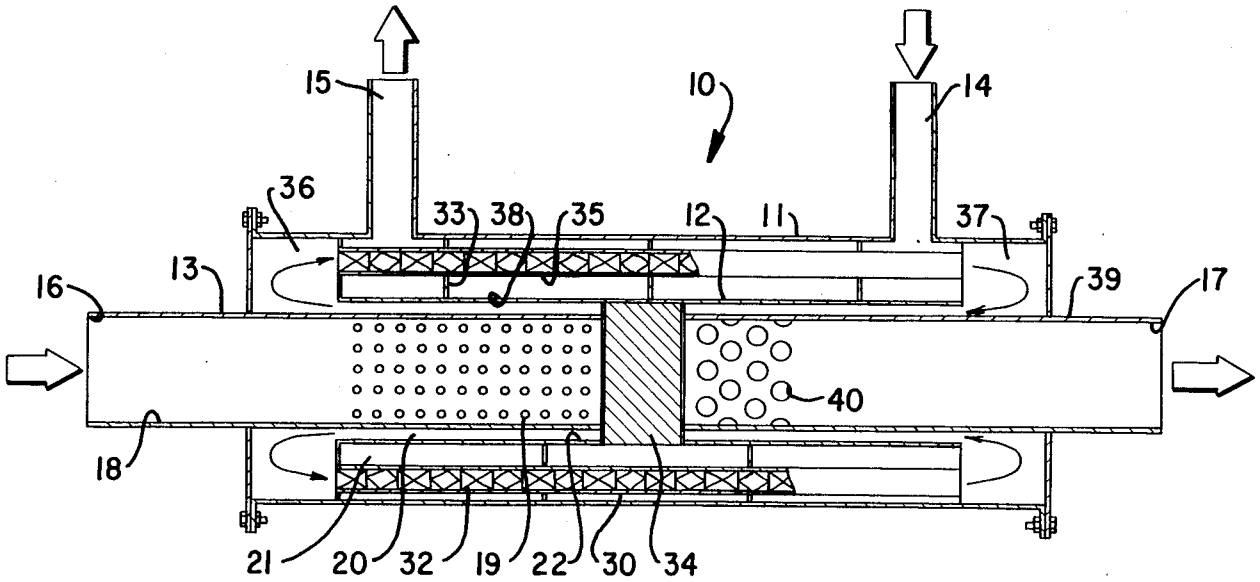
FIG. 6 is a longitudinal sectional view taken through a fourth embodiment of the heat exchanger according to the invention.

In the fourth embodiment as shown in FIG. 6, a second inner tube 39 is fixed to the casing 11 and provided with a number of holes 40. After the expansion space 37, the fluid flows from the holes 40 to the outlet 17 of the inner tube 39. The holes 40 provide a silencing effect. One can use the heat exchanger of FIG. 4 or FIG. 6 or a combination of the two, depending upon the diameter, number and distribution of the holes 19, and the area of the heat transfer surface which are determined to obtain the specific performance desired.

Figure 7:
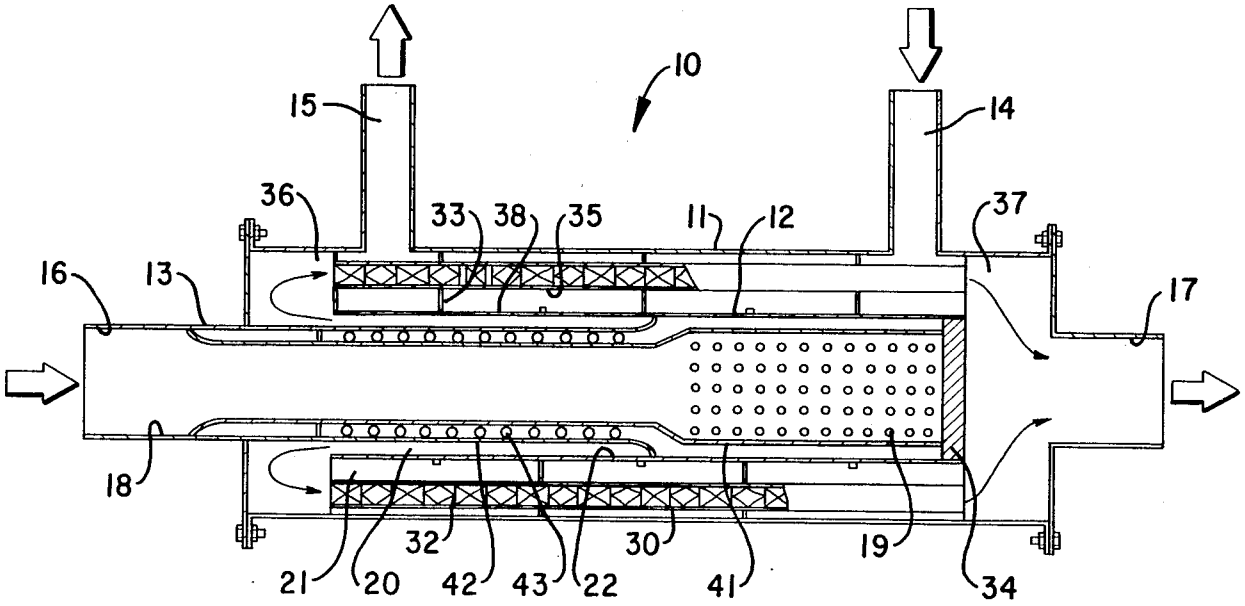
FIG. 7 is a longitudinal sectional view taken through a fifth embodiment of the heat exchanger according to the invention.

In the fifth embodiment as shown in FIG. 7, the inner tube 13 includes inner and outer members 41,42 with holes 19,43. Fluid passing from the inlet 16 of the inner tube 13 to the outlet 17 strikes the inner wall 22 of the outer tube 12 (the second heat transfer surface) from the holes 43 of the inner tube 13 as a jet stream after passing similarly through the holes 19, the inner wall 22 (the first heat transfer surface). The fluid is then guided to the circumferential surface of the twist tube 30 (the third heat transfer surface). The jet stream effect is repeated, so the heat transfer coefficient and the heat exchanger effectiveness are higher than in FIG. 4.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letter Patent of the United States is:

1. A heat exchanger, comprising:

a casing having a hollow cylindrical shape and provided with inlet and outlet ports;

at least one outer tube fixedly connected to and positioned within said casing;

at least one inner tube fixedly inserted into said outer tube so as to form a space therebetween and provided with a plurality of holes formed on a substantially entire circumferential surface thereof for directly spraying a first heated fluid to an inner wall of said outer tube and therethrough wherein an outer wall of said outer tube further comprises a first heat transfer surface for directly facing a second fluid to be heated passing through said casing;

passage means for said first heated fluid, said passage means being positioned between said casing and said outer tube and communicating with a first open end of said space formed between said outer tube and said inner tube and having a second heat transfer surface for directly facing said second fluid at an outer circumferential surface of said second heat transfer surface; and sealing means positioned in said outer tube for closing one end of said inner tube and for closing a second end of said space opposite said first open end.

2. A heat exchanger as set forth in claim 1 wherein said passage means further comprises means for generating turbulence in said first heated fluid.

3. A heat exchanger as set forth in claim 2 wherein said means for generating turbulence further comprises a series of twist strips.

4. A heat exchanger as set forth in claim 2 wherein first and second ends of said outer tube are fixedly connected to an inner wall of said casing.

5. A heat exchanger as set forth in claim 2 further comprising an expansion chamber formed between said holes of said inner tube and said outer tube.

6. A heat exchanger as set forth in claim 2 further comprising an expansion chamber formed downstream of said inner tube.

7. A heat exchanger as set forth in claim 1, wherein said casing further comprises baffle means for generating swirling flow of said second fluid.

8. A heat exchanger as set forth in claim 7, wherein said baffle means further comprises a plurality of plates.

* * * * *

UNITED STATES PATENT AND TRADEMARK OFFICE

CERTIFICATE OF CORRECTION

PATENT NO. : 4,694,894

DATED : SEp. 22, 1987

INVENTOR(S) : Masahiro KITO et al.

It is certified that error appears in the above-identified patent and that said Letters Patent is hereby corrected as shown below:

At Column 2, line 18, change "23, 25, 26" to --24, 25, 26--.

At Column 3, Line 28, change "Letter" to --Letters--.

Signed and Sealed this

Fifteenth Day of March, 1988

*Attest:*

*Attesting Officer*

DONALD J. QUIGG

*Commissioner of Patents and Trademarks*